US006187067B1

(12) United States Patent
Guimaraes et al.

(10) Patent No.: US 6,187,067 B1
(45) Date of Patent: Feb. 13, 2001

(54) ADDITIVATED GAS FOR OXY-CUTTING AND/OR HEATING APPLICATIONS

(75) Inventors: Alexandre de Moraes Guimaraes; Willian de Abreu Macedo, both of Rio de Janeiro (BR)

(73) Assignee: Praxair Technology, Inc., Danbury, CT (US)

( * ) Notice: Under 35 U.S.C. 154(b), the term of this patent shall be extended for 0 days.

(21) Appl. No.: 09/229,164

(22) Filed: Jan. 13, 1999

(30) Foreign Application Priority Data

Jan. 16, 1998 (BR) ..... 9800346

(51) Int. Cl.[7] ..... C10J 1/00
(52) U.S. Cl. ..... 48/197 FM; 585/6
(58) Field of Search ..... 48/197 FM; 252/372; 585/14, 20, 23, 24, 6

(56) References Cited

U.S. PATENT DOCUMENTS 3,796,554 * 3/1974 Meinass ..... 48/197 FM

* cited by examiner

*Primary Examiner*—Shrive Beck
*Assistant Examiner*—Frederick Varcoe
(74) *Attorney, Agent, or Firm*—Donald T. Black

(57) ABSTRACT

Additivated gas for oxy-cutting and/or heating applications, having a low cost of production and high cutting and heating velocities wherein the additivated gas is obtained by the additivation of propylene with a chemical product having the basic constituents selected from the group consisting of aromatic compounds, paraffins and naphthenic compounds.

7 Claims, No Drawings

ADDITIVATED GAS FOR OXY-CUTTING AND/OR HEATING APPLICATIONS

FIELD OF THE INVENTION

The present invention refers to an additivated gas for oxy-cutting and/or heating applications, more specifically, to an additivated fuel gas for use in oxy-cutting and/or heating operations, as well as its composition thereof.

BACKGROUND OF THE INVENTION

Until recently, most of the industrial oxy-cutting and/or heating operations employed acetylene as fuel gas. Acetylene presented favorable cutting and heating characteristics because it has a high concentration of heat, temperature and flame emissivity, as well as a reduced consumption of oxygen necessary to the flame. Consequently, it provides a desirable technical performance when compared to the other available fuel gases.

However, despite proven technical advantages, the technologies for producing acetylene have not developed so much as to permit or provide a significant cost reduction for the use thereof. Thus, because acetylene is one of the most expensive gases among the gases available in the marketplace due to its high production cost which involves, among other factors, the manufacture of calcium carbide as the raw material for the acetylene, the operations of preparing and introducing the porous mass into the cylinders, the addition of acetone and filling the cylinders renders acetylene little economic competitiveness as compared to other fuel gases. In view of this, the consumers of fuel gases for oxy-cutting and heating operations are searching for a reduction in their operational costs through energetic alternatives which have a more competitive pricing than that of acetylene.

The production cost of the applications involving fuel gases is directly related to the characteristics of the oxygen consumption requirement of the fuel gas to produce the flame. Acetylene has been keeping competitive, although its prices are higher than the other fuel gas alternatives, since it requires a lower oxygen volume. The oxygen costs are, therefore, determinant in order that the acetylene be competitive with the other alternate fuel gases. The continuous development of new oxygen producing technologies is significantly reducing the producing costs of these gases, providing a reduction in the average prices thereof. In view of this, other fuel gas alternates have become viable, as their producing costs are lower than that of the acetylene, although these fuel gases need a greater oxygen amount for the flame.

In view of the high costs of the applications employing acetylene, fuel gas alternates are being investigated, the prices of which are lower than that of acetylene. Thus, GLP, propylene and additivated GLP, among others, are being currently utilized by the industry.

Although requiring a greater oxygen volume for carrying out the combustion, GLP has been employed in industrial applications, favored by the reduction in the average oxygen price and its low price.

Propylene, like GLP, is a petroleum based liquefied gas and another alternative to the use of acetylene in industrial gas processes. It is relatively less expensive as compared to acetylene and, although propylene requires a higher oxygen consumption to produce the flame, it is also favored by the current reduction in the average oxygen price in the marketplace. Although propylene has a price greater than that of GLP, there is a great difference between the ratios of consumption of oxygen required by GLP and by propylene, thus allowing the achievement of a lower final cost on behalf of propylene in industrial processes.

Additivated GLP is a recent alternative obtained by means of the GLP chemical additivation, which enhances the combustion characteristics of this gas, matching it with propylene, without, however, causing a significant increase in the production cost and, consequently, in the final price of the fuel.

In addition to price, another advantage of the liquefied gases over the acetylene is the form for storing the product. While acetylene is conditioned in cylinders and dissolved in adequate solvent, the liquefied gases are stored in the liquid form, in cylinders or tanks of high capacity, bringing about a lower conveying cost and higher handling safety.

Although these alternate fuel gases are being employed in place of acetylene, they do not allow for a completely satisfactory substitution of the acetylene, due to the low productivity of these gases, as they do not provide cutting velocities equal to or greater than those obtained by the acetylene, since they present an oxygen consumption superior to that presented by the acetylene.

Therefore, it is an objective of the present invention to present an additivated fuel gas for oxy-cutting and/or heating applications, which is able to provide a higher productivity, that is, a higher cutting velocity and a lower oxygen and fuel gas consumption.

It is another objective of the present invention to present an additivated fuel gas for oxy-cutting and/or heating applications having a low cost of production.

These and other objectives of the present invention are achieved by the additivation of propylene with a chemical product having as basic constituents aromatic compounds, paraffins and naphthenic compounds, at such concentrations that it provides a cutting and heating productivity superior to the fuel gases currently employed, providing higher cutting velocities, a lower oxygen and fuel gas consumption, as well as having a low cost of production.

SUMMARY OF THE INVENTION

The additivated fuel gas of the present invention is obtained by the additivation of propylene, the purity of which may vary from 93% to 99.5%, with a chemical additive having as basic constituents aromatic compounds (C9–C10), paraffins (C6–C12) and naphthenic compounds (C9–C10), at concentrations that may vary from 2% to 10% by volume.

DETAILED DESCRIPTION

With the purpose of exemplifying and proving the advantages of the additivated fuel gas of the present invention, several experimental rectilinear type cuts were effected, by automatic process, into the carbon-steel SAE 1020 plates presenting the same superficial conditions of 250 mm in length, at thickness of ¼", ½", 1", 2" and 3", as per rule AWX C4.1-77 sample 3, by employing the fuel gases presently used and the additivated fuel gas of the present invention, by varying the propylene purity grade from 93% to 99.5%, and the additive concentration from 2% to 10% by volume.

The following Table 1 shows the average results of the cutting velocities in mm/min obtained in the experiences for several fuel gases currently employed and the additivated fuel gas of the present invention, at the additive concentrations by volume and propylene purity grades that showed the best results.

TABLE 1

| Fuel Gas | Plate thickness ¼" | ½" | 1" | 2" | 3" |
|---|---|---|---|---|---|
| Acetylene | 66.5 | 58.7 | 50.0 | 37.2 | 29.5 |
| GLP | 61.2 | 56.0 | 42.5 | 31.6 | 26.0 |
| Additivated GLP | 66.0 | 59.3 | 44.1 | 33.6 | 27.1 |
| Propylene 93% | 63.0 | 56.5 | 48.0 | 35.0 | 28.0 |
| Propylene 93% + 3% of Additive | 70.5 | 63.0 | 54.5 | 46.0 | 38.0 |
| Propylene 93% + 6.7% of Additive | 71.0 | 67.0 | 58.9 | 48.0 | 44.5 |
| Propylene 93% + 10% of Additive | 70.0 | 62.0 | 51.0 | 41.5 | 29.0 |
| Propylene 99.5% | 64.0 | 57.0 | 49.0 | 39.5 | 31.0 |
| Propylene 99.5% + 2% of Additive | 67.6 | 63.5 | 56.1 | 44.0 | 36.0 |
| Propylene 99.5% + 3.9% of Additive | 68.0 | 64.0 | 56.5 | 45.0 | 37.0 |

It can be ascertained from Table 1 that the additivated propylene presents cutting velocity values superior to the other fuel gases, including the pure propylene. The additivation of propylene 93%, with additive concentrations varying from 3% to 10% by volume, allows to obtain cutting velocities superior to the other fuel gases for all thickness evaluated, the same occurring with propylene 99.5%, with additive concentrations varying from 2% to 4.5% by volume, the best results being obtained with propylene 93% having a concentration of 6–8% by volume of additive and propylene 99.5% with a concentration of 2.5–4.5% by volume of additive.

Table 2 below shows the percentages of productivity gains obtained with propylene 93% having a concentration of 6.7% by volume of additive, compared to the other fuel gases.

TABLE 2

| Fuel Gas | Plate thickness ¼" | ½" | 1" | 2" | 3" |
|---|---|---|---|---|---|
| Acetylene | 6.77 | 14.14 | 17.80 | 29.03 | 50.85 |
| GLP | 16.01 | 19.64 | 38.59 | 51.90 | 71.15 |
| Additivated GLP | 7.58 | 12.98 | 33.56 | 42.86 | 64.21 |
| Propylene 93% | 12.70 | 18.58 | 22.71 | 37.14 | 58.93 |
| Propylene 99.5% | 10.94 | 17.54 | 20.20 | 21.52 | 43.55 |

It can be noted from Table 2 above that propylene 93%, having a concentration of 6.7% by volume of additive, allows the productivity gains to vary from 6.77% to 50.85% in relation to acetylene, from 16.01% to 71.15% in relation to GLP, from 7.58% to 64.21% in relation to additivated GLP, from 12.70% to 58.93% in relation to non-additivated propylene 93%, and from 10.94% to 43.55% in relation to non-additivated propylene 99.5%. This occurs because the decrease rate of the cutting velocity with the increase of the plate thickness is reduced when propylene 93%, having a concentration of 6.7% by volume of additive, is used.

The following Tables 3 and 4 show the total fuel gas and oxygen consumption values, for the cut, of propylene 93% with a concentration of 6.7% by volume of additive, of propylene 99.5% with a concentration of 3.9% by volume of additive, as well as of the other fuel gases, proving that the additivation of propylene with an additive provides significant advantages over the other fuel gases in reducing the consumption of the gases involved.

Table 3 below shows the total fuel gas consumption for a variety of plate thickness, in kg, of propylene 93% with a concentration of 6.7% by volume of additive, and of propylene 99.5% with a concentration of 3.9% by volume of additive, as well as of the other fuel gases.

TABLE 3

| Fuel Gas | Plate thickness ¼" | ½" | 1" | 2" | 3" |
|---|---|---|---|---|---|
| Acetylene | 0.00715 | 0.01318 | 0.01629 | 0.02243 | 0.02893 |
| GLP | 0.00841 | 0.01930 | 0.02823 | 0.04186 | 0.05326 |
| Additivated GLP | 0.01182 | 0.01434 | 0.02057 | 0.02874 | 0.04009 |
| Propylene 93% | 0.01591 | 0.01883 | 0.02335 | 0.03496 | 0.04549 |
| Propylene 93% + 6.7% of Additive | 0.0070I | 0.01065 | 0.01348 | 0.01692 | 0.02107 |
| Propylene 99.5% | 0.00806 | 0.01011 | 0.01725 | 0.02423 | 0.03440 |
| Propylene 99.5% + 3.9% of Additive | 0.00751 | 0.00959 | 0.01576 | 0.02738 | 0.03456 |

It can be seen from Table 3 that the fuel gas consumption, using the additivated propylene is utilized, especially propylene 93% with a concentration of 6.7% by volume of additive, is lower than the consumption of the other fuel gases for all plate thickness analyzed.

Table 4 below shows the total oxygen consumption for the cut, in m3, of propylene 93% with a concentration of 6.7% by volume of additive, and of propylene 99.5% with a concentration of 3.9% by volume of additive, as well as of the other fuel gases.

TABLE 4

| Fuel Gas | Plate thickness ¼" | ½" | 1" | 2" | 3" |
|---|---|---|---|---|---|
| Acetylene | 0.04511 | 0.06086 | 0.10082 | 0.20830 | 0.38302 |
| GLP | 0.05312 | 0.07711 | 0.13986 | 0.32614 | 0.45449 |
| Additivated GLP | 0.04567 | 0.07378 | 0.12366 | 0.34197 | 0.50207 |
| Propylene 93% | 0.05743 | 0.07464 | 0.15966 | 0.38550 | 0.54324 |
| Propylene 93% + 6.7% of Additive | 0.04621 | 0.06565 | 0.10285 | 0.20672 | 0.30052 |
| Propylene 99.5% | 0.04673 | 0.06609 | 0.10873 | 0.23924 | 0.46491 |
| Propylene 99.5% + 3.9% of Additive | 0.04231 | 0.06345 | 0.09612 | 0.26990 | 0.4773 |

It can be noted from Table 4 that the total oxygen consumption when the additivated propylene is utilized, especially propylene 93% with a concentration of 6.7% by volume of additive, is lower than the consumption of the other fuel gases for all thickness analyzed.

As shown in Tables 3 and 4, when propylene 10 additivated is employed with the product having, as basic constituents, aromatic compounds (C9–C10), paraffins (C6–C12) and naphthenic compounds (C9–C10), especially propylene 93% with a concentration of 6.7% by volume of additive, a lower fuel gas and oxygen consumption is necessary, which, together with the fact that it presents a higher cutting velocity, as showed in Table 1, and taking into account the prices of the gases involved in the oxy-cutting operation, provide the accomplishment of cuts with a lower cost than the other fuel gases, this reduction being more accentuated for cuts of plates having higher thickness.

Although the invention has been described with respect to specific embodiments, it will be appreciated that it is intended to cover all modifications and equivalents within the scope of the appended claims.

What is claimed is:

1. An additivated gas for oxy-cutting and/or heating applications comprised of propylene having a purity of 93% to 99.5% additivated with a chemical product having a concentration in the additivated gas of 2% to 10% by volume, wherein said chemical product is selected from the group consisting of C9–C10 aromatic compounds, C6–C12 paraffins and C9–C10 naphthenic compounds.

2. The additivated gas according to claim 1, comprised of 93% purity propylene additivated with said chemical product having a concentration in the additivated gas of 3% to 10% by volume.

3. The additivated gas according to claim 2, comprised of 93% purity propylene additivated with said chemical product having a concentration in the additivated gas of 6% to 8% by volume.

4. The additivated gas according to claim 2, comprised of 93% purity propylene additivated with said chemical product having a concentration in the additivated gas of 6.5% to 7.5% by volume.

5. The additivated gas according to claim 1, comprised of 99.5% purity propylene additivated with said chemical product having a concentration in the additivated gas of 6.5% to 7.5% by volume.

6. The additivated gas according to claim 5, comprised of 99.5% purity propylene additivated with said chemical product having a concentration in the additivated gas of 2.5% to 4.5% by volume.

7. The additivated gas according to claim 5, comprised of 99.5% purity propylene additivated with said chemical product having a concentration in the additivated gas of 3% to 4% by volume.

* * * * *